US010086259B2

(12) United States Patent
Schmidt et al.

(10) Patent No.: US 10,086,259 B2
(45) Date of Patent: Oct. 2, 2018

(54) APPARATUS, COMPUTER-READABLE MEDIUM, AND METHOD FOR SORTING AND RECOVERING CARDS

(71) Applicant: Giesecke & Devrient America, Inc., Dulles, VA (US)

(72) Inventors: Alfred Schmidt, Munich (DE); Stefan Schneider, Miesbach (DE); James Goodwin, Las Vegas, NV (US)

(73) Assignee: Giesecke+Devrient Currency Technology America, Inc., Dulles, VA (US)

( * ) Notice: Subject to any disclaimer, the term of this patent is extended or adjusted under 35 U.S.C. 154(b) by 108 days.

(21) Appl. No.: 14/023,175

(22) Filed: Sep. 10, 2013

(65) Prior Publication Data

US 2015/0069700 A1 Mar. 12, 2015

(51) Int. Cl.

| | |
|---|---|
| ***A63F 1/06*** | (2006.01) |
| ***A63F 1/14*** | (2006.01) |
| ***B07C 5/342*** | (2006.01) |
| ***A63F 9/24*** | (2006.01) |

(52) U.S. Cl.

CPC ..... *A63F 1/06* (2013.01); *A63F 1/14* (2013.01); *B07C 5/3422* (2013.01); *A63F 2009/2419* (2013.01); *A63F 2250/58* (2013.01)

(58) Field of Classification Search

None

See application file for complete search history.

(56) References Cited

U.S. PATENT DOCUMENTS

| | | | | |
|---|---|---|---|---|
| 6,250,632 | B1 | 6/2001 | Albrecht | |
| 7,959,153 | B2 | 6/2011 | Franks, Jr. | |
| 2002/0017481 | A1* | 2/2002 | Johnson | A63F 1/12 209/547 |
| 2008/0001356 | A1* | 1/2008 | Franks | 273/148 R |
| 2014/0033660 | A1* | 2/2014 | Shigeta | A63F 1/062 53/492 |

* cited by examiner

*Primary Examiner* — Robert T Clarke, Jr.

(74) *Attorney, Agent, or Firm* — Drinker Biddle & Reath LLP

(57) ABSTRACT

An unused card sorting and recovering apparatus includes a card input device, a card sensing device, a card sorting device, and a card disposing device. The apparatus further includes a plurality of pockets, each of the plurality of pockets configured to hold one or more cards. The apparatus further includes a controller configured to, for each of a plurality of cards, determine an identity of the card, determine whether at least one pocket of the plurality of pockets is missing the card from a complete deck based on the identity of the card, instruct the card sorting device to distribute the card to a pocket of the at least one pocket of the plurality of pockets that is missing the card, or instruct the card sorting device to distribute the card to a holding device. The apparatus further comprises a resetting device configured to reset specific pockets.

27 Claims, 8 Drawing Sheets

APPARATUS, COMPUTER-READABLE MEDIUM, AND METHOD FOR SORTING AND RECOVERING CARDS

TECHNICAL FIELD

The present disclosure relates to sorting and recovering cards and, in particular, to an apparatus, computer-readable medium, and method for sorting and recovering unused playing cards in casino games.

BACKGROUND

Each day, the gaming industry uses an untold number of playing cards. Decks of cards are typically distributed to gaming tables and used for a limited amount of time (e.g., a few hours, a day, etc.). After that amount of time, the cards are collected. To monitor possible fraud and cheating, the collected cards may be counted to determine whether any cards have been added or removed from the distributed decks. Additionally, the collected cards may be marked or destroyed to prevent use in a future live game.

In some casinos, gaming tables may be assigned as many as fifty (50) decks of cards depending on the needs of each game. By using a large number of decks, casinos can maintain a high quality and integrity level of the cards at each table. Specifically, because each card is likely to be used only once, the risk of card tampering is reduced and casino clients are assured that the cards they are handling are new. The decks of cards are shuffled together and placed in a prepared stack for each game. At the end of each day, the decks are collected and marked as used or destroyed. Due to the large number of decks that are assigned to each gaming table, many cards in those decks may remain unused. Nevertheless, those unused cards are collected along with the used cards and marked or destroyed at the end of each day.

Cards that are marked are redistributed or repurposed (e.g., made available for charity giveaways, resale as souvenirs, etc.). U.S. Pat. No. 7,959,153, incorporated herein by reference, discloses an apparatus for automatic cancellation and sorting of used or new playing cards by collecting cards following use in a casino game, marking the cards so that they cannot be reused in a casino game, and sorting the cards into decks for sale or distribution to the public. As disclosed in that patent, marking may be accomplished by using a card cancelling device such as a punch die, a cutting device, or other device for permanently including a mark indicative of cancellation on a card. But, even when cards are marked for redistribution, the cost of marking each card is significant and the original value of each card is never recovered. As a result, unused cards represent a substantial loss for casinos each year.

U.S. Pat. No. 6,250,632 discloses an automatic card sorter designed to shuffle cards for reuse or to sort the cards into decks for redistribution. Nevertheless, as disclosed in U.S. Pat. No. 7,959,153, the apparatus has several disadvantages, including: (i) the use of a large number of trays (specifically, fifty-two (52)), which adds to the size and complexity of the apparatus; and (ii) the need to move each of the trays into position, one at a time, to receive cards, which results in a sorting process that is relatively inefficient for many types of sortings. Moreover, the apparatus disclosed in the '632 patent is not capable of inspecting and verifying the condition of a card such as determining whether the card has a flaw (e.g., a marking, an indent, a cut, a hole, graffiti, etc.) that may allow someone to gain advantage during a game.

In addition, some casinos use different types of cards for different games. For example, cards with different designs may be used at the blackjack tables and the baccarat tables. Intermixing decks of different types of cards can cause confusion and provide some players with an unfair advantage. Accordingly, casinos often sort cards of each type separately. However, the effort and expense of keeping track of cards of each type is significant. As disclosed in the '153 patent, header cards can be used to separate decks into groups (e.g., decks that originate from different gaming tables). The header cards include barcodes or other markings for identification. Nevertheless, problems arise when a card of a first type is accidentally or intentionally introduced into a stack of cards of another type. Locating the dissimilar card in that stack of cards is a costly and labor-intensive process; therefore, the entire stack of cards may be destroyed to prevent potential confusion and manipulation.

Thus, from an efficiency and cost standpoint, there exists a need for a more robust manner of sorting and recovering cards, especially cards that have been designated for disposal after having not been used after a day at the casino.

SUMMARY OF INVENTION

According to an embodiment of the present invention, an apparatus for automatically sorting and recovering cards includes a card input device configured to receive a plurality of cards; a card sensing device configured to obtain data associated with each of the plurality of cards; and a card sorting device configured to distribute a card to one of a plurality of pockets according to a predetermined scheme to form a complete set, each of the plurality of pockets configured to hold one or more cards of the plurality of cards. The apparatus also includes a controller configured to, for each of the plurality of cards: (i) determine an identity of the card based on the data associated with the card; (ii) determine whether at least one pocket of the plurality of pockets is missing the card from the complete set based on the identity of the card; (iii) instruct the card sorting device to distribute the card to a pocket of the at least one pocket of the plurality of pockets that is missing the card in response to determining that the at least one pocket of the plurality of pockets is missing the card from a complete set; and (iv) instruct the card sorting device to distribute the card to a holding device in response to determining that the at least one pocket of the plurality of pockets is not missing the card from the complete set, the holding device configured to hold the card. The apparatus also includes a resetting device configured to, when a specific pocket holds a plurality of distributed cards comprising the complete set, reset the specific pocket. The apparatus also includes a transport device configured to transport the plurality of cards from the card input device to the card sensing device and the card sorting device.

According to another embodiment of the present invention, a non-transitory, computer-readable medium is configured to store computer-readable instructions that, when executed by a computer, instruct the computer to perform a method for automatically sorting and recovering cards. The method includes, for each of a plurality of cards, obtaining data associated with the card; determining an identity of the card based on the data associated with the card; determining whether at least one pocket of a plurality of pockets is missing the card from a complete set according to a predetermined scheme based on the identity of the card, each of the plurality of pockets configured to hold one or more cards of the plurality of cards; distributing the card to a pocket of the at least one pocket of the plurality of pockets that is missing the card from the complete set based on a predetermined scheme in response to determining that the at least one pocket of the plurality of pockets is missing the card; and distributing the card to a holding device in response to determining that the at least one pocket of the plurality of pockets is not missing the card from the complete set, the holding device configured to hold the card. The computer-readable instructions further include an instruction that when a specific pocket holds a plurality of distributed cards comprising a complete set, resetting the specific pocket.

According to yet another embodiment of the present invention, a method for automatically sorting and recovering cards includes receiving a plurality of cards. The method also includes, for each of the plurality of cards, obtaining data associated with the card via a card sensing device; determining an identity of the card based on the data associated with the card; determining whether at least one pocket of a plurality of pockets is missing the card from a complete set according to a predetermined scheme based on the identity of the card, each of the plurality of pockets configured to hold one or more cards of the plurality of cards; distributing the card to a pocket of the at least one pocket of the plurality of pockets that is missing the card from the complete set in response to determining that the at least one pocket of the plurality of pockets is missing the card; and distributing the card to a holding device in response to determining that the at least one pocket of the plurality of pockets is not missing the card from a complete set, the holding device configured to hold the card. The method also includes, when specific a pocket holds a plurality of distributed cards comprising a complete deck, resetting the specific pocket.

Other objects, features, and advantages will be apparent to persons of ordinary skill in the art from the following detailed description and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION

Embodiments of the present invention, and their features and advantages, may be understood by referring to FIGS. 1-6, like numerals being used for corresponding parts in the various drawings.

In the gaming industry, many decks of cards are used each day. For example, a gaming table may be assigned fifty (50) decks of cards before the opening of a game session. The cards in the decks are pre-shuffled and placed in a dealer shoe at the gaming table. Cards are then removed from the shoe according to the needs of the game and used only once. At the end of the day or shift, the used cards and any remaining cards in the shoe are collected. To prevent fraud and cheating, cards, even those that have not been used at all, may be securely destroyed or marked to make sure that they cannot be reused in a live game session. For casinos, the cost of destroying unused cards can total as much as $20 million per year.

Exemplary embodiments of the present invention provide an apparatus, computer-readable medium, and method for automatically sorting and recovering cards, such as, for example, playing cards that are used in the gaming industry. Such embodiments are capable of sorting assigned but unused cards and recovering complete decks of cards. A system, for example, a banknote processing system, such as the BPS M5 offered by Giesecke & Devrient, GmbH, may be equipped with the necessary tools and instructions to read, verify, and sort cards. Specifically, the BPS M5 may be adapted and reprogrammed to identify the denomination of playing cards (e.g., suit and/or rank), sort the playing cards into decks, and band or wrap the decks. Playing cards that are placed in a feeder attached to the BPS M5 are singled, and an image sensor on the BPS M5 discriminates the suit and rank of each playing card. The BPS M5 then distributes the playing cards to one or more stackers. Once a stacker collects a complete deck, the deck is banded. Any remaining cards are subsequently destroyed by an online shredder or stacked separately for offline destruction.

Figure 1:
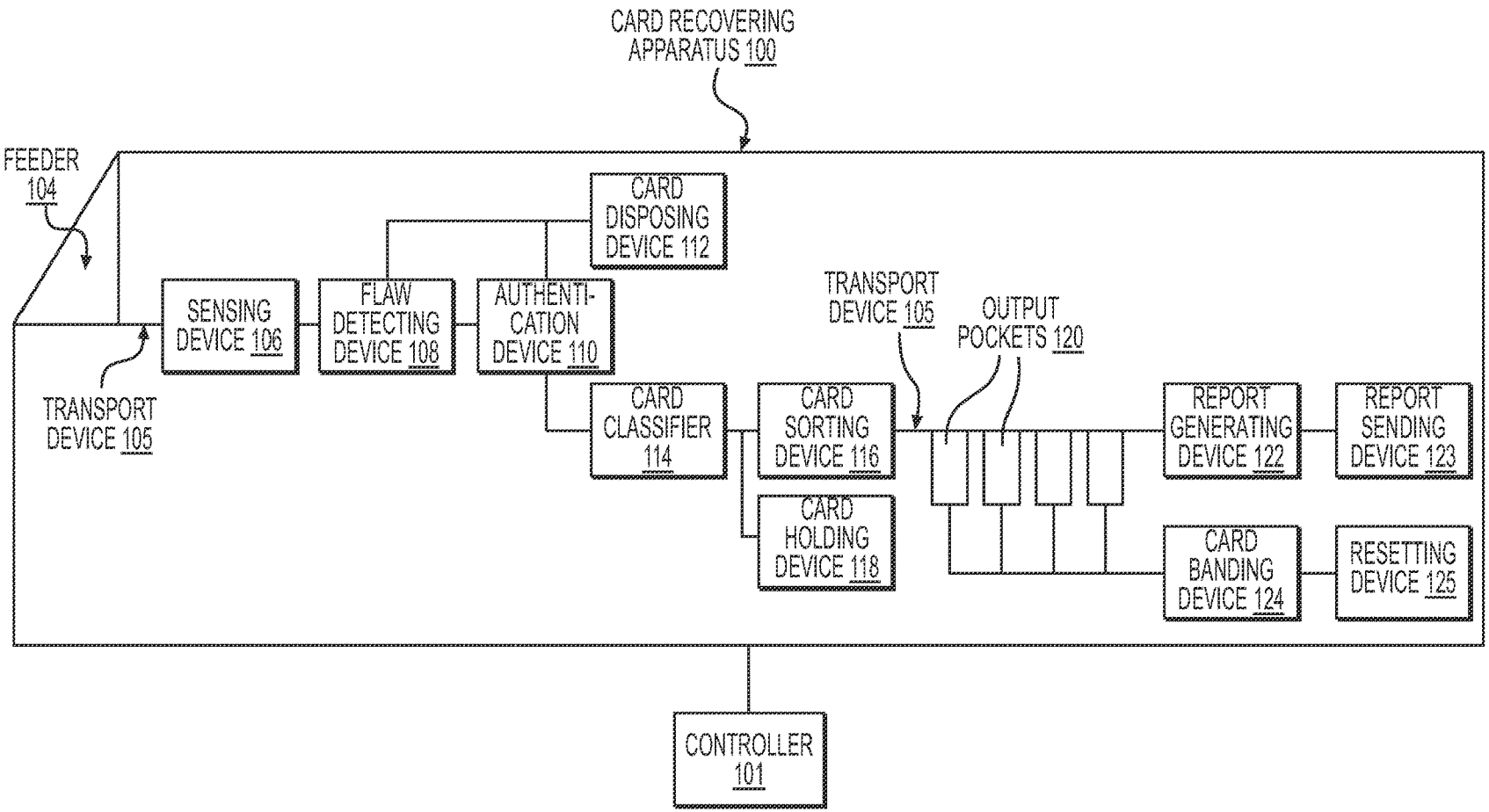
FIG. 1 is a block diagram of an exemplary card recovering apparatus according to an embodiment of the invention.

Referring now to FIG. 1, a block diagram of an exemplary card recovering apparatus 100 according to an embodiment of the invention, is described. Card recovering apparatus 100 comprises a feeder 104, a sensing device 106, a flaw detecting device 108, an authentication device 110, a card disposing device 112, a card classifier 114, a card sorting device 116, a card holding device 118, output pockets 120, a report generating device 122, a report sending device 123, a card banding device 124, and a resetting device 125.

One or more of feeder 104, sensing device 106, flaw detecting device 108, authentication device 110, card disposing device 112, card classifier 114, card sorting device 116, card holding device 118, output pockets 120, report generating device 122, report sending device 123, card banding device 124, and resetting device 125 are linked by transport mechanisms such as belts, pneumatic conveyors, or other conveying mechanisms capable of transporting sheet-like materials such as cards for automatically transporting cards between or within the devices. These transport mechanisms are individually or collectively represented by a transport device 105. The transport paths between each device are preferably as short and straight as possible to minimize the possibility of jamming or misfeeding. Open areas may be included in the card paths to provide access to cards and to permit imaging of both sides of a card.

In addition, one or more of feeder 104, sensing device 106, flaw detecting device 108, authentication device 110, card disposing device 112, card classifier 114, card sorting device 116, card holding device 118, output pockets 120, report generating device 122, report sending device 123, card banding device 124, resetting device 125, and transport device 105 are included within at least one housing (not depicted) having a display and an input device for inputting data or commands. The housing is preferably a freestanding portable housing on casters, wheels, or the like to allow movement within the card processing room. Portions of the housing may be removed or adjusted to facilitate access to cards and/or devices within card recovering apparatus 100, for example, for cleaning, repairing, replacing, or removing purposes.

Figure 2:
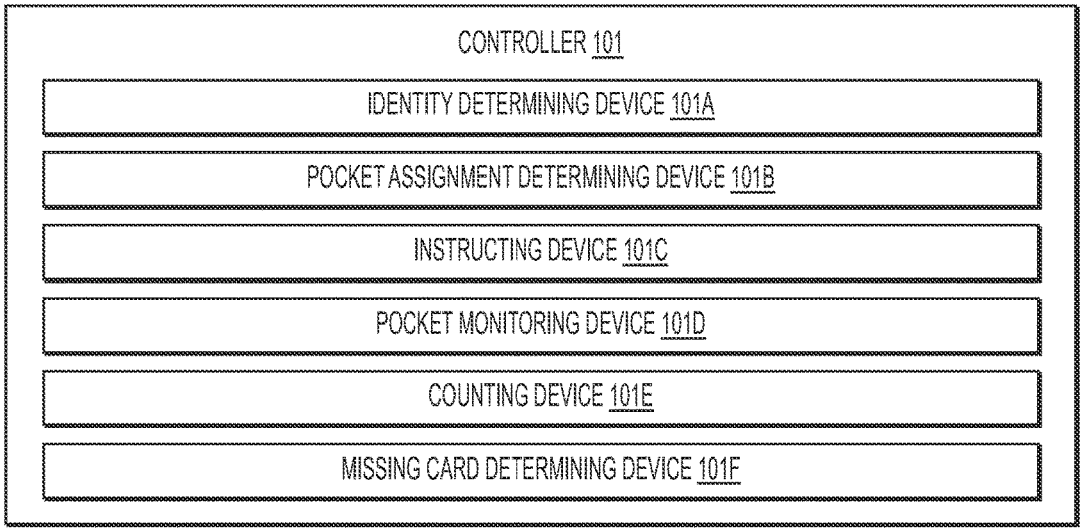
FIG. 2 is a schematic representation of an exemplary controller according to an embodiment of the invention.

Moreover, card recovering apparatus 100 comprises a controller 101. Controller 101 may represent one or more controllers, such as a central controller and/or individual device controllers. Controller 101 can be located either within card recovering device 100 or an external controller that is connected to card recovering apparatus 100 via a wired or wireless interface. Controller 101 is configured to control one or more of feeder 104, sensing device 106, flaw detecting device 108, authentication device 110, card disposing device 112, card classifier 114, card sorting device 116, card holding device 118, output pockets 120, report generating device 122, report sending device 123, card banding device 124, resetting device 125, and transport device 105 according to, for example, the flowcharts of FIGS. 3 and 5. As depicted in FIG. 2, controller 101 is capable of operating as an identity determining device 101A, a pocket assignment determining device 101B, an instructing device 101C, a pocket monitoring device 101D, a counting device 101E, and a missing card determining device 101F.

Cards are input into card recovering apparatus 100 via a card input device. Feeder 104 is an example of the card input device. Feeder 104 is capable of receiving a plurality of cards, and includes one or more receptacles such as bins, hoppers, or other compartments for inputting cards. Each receptacle is appropriately shaped to receive one or more cards. Specifically, each receptacle may be sufficiently large to receive multiple decks of cards. Cards can be, for example, stacked one on top of another in a receptacle. After being placed in the one or more receptacles, a plurality of cards is separated by feeder 104 and transported by transport device 105 to sensing device 106.

As the plurality of cards is fed through sensing device 106, sensing device 106 obtains data associated with each card of the plurality of cards. Sensing device 106 includes one or more of a camera, a barcode reader, a scanner, or other imaging device. Suitable imaging devices can be adapted from currency or ticket readers. Sensing device 106 captures or retrieves an image of or data regarding each card or portions of each card. In one example, sensing device 106 includes a camera to take a picture of one or both sides of each card. In another example, sensing device 106 includes a barcode reader to read serial numbers or barcodes printed on each card. The serial number or barcode printed on a card provides information (e.g., denomination information, group or classification information, etc.) about that card. In yet another example, sensing device 106 is configured to retrieve information about each card from an information resource (e.g., a local or remote server, network, or other device). Specifically, in such cases, sensing device 106 interfaces with the information resource and locate information stored about the card.

The images and/or data obtained by sensing device 106 may be used for card identification, counting, grading, verification, and classification. Card counting is useful for security purposes in order to alert a casino or other gaming establishment of missing cards that could be used fraudulently. Upon being alerted, a casino will have time to take preventive measures (e.g., change to new cards, set up monitoring, etc.) to reduce the risk of cheating. Card grading is useful to determine whether cards have been damaged and thus are unsuitable for recovering and reuse.

In addition to sensing device 106 or other sensing devices that permit identification, verification, and/or inspection of cards, card recovering apparatus 100 may include sensors for carrying out functions such as card routing, identifying misfeeds (e.g., double or multi-card feeds, skewed feeds, etc.) or jams, and so forth, as is well-known in the art of document or sheet feeding. For example, such sensors include barcode readers, scanners, or other imaging devices capable of reading the barcodes on header cards that separate decks into different groups. These sensors may be associated with or independent of sensing device 106.

Sensing device 106 is connected to one or more of controller 101, flaw detecting device 108, authentication device 110, card classifier 114, card sorting device 116, and card holding device 118. Controller 101, operating as identity determining device 101A (as depicted in FIG. 2), uses the images and/or data obtained by sensing device 106 to determine an identity (e.g., a denomination) of each card of the plurality of cards. For example, controller 101 uses the images and/or data to determine each card's denomination (e.g., a suit and/or a rank). Controller 101, in such a capacity, serves as a denomination classifier.

In addition, flaw detecting device 108 uses the images and/or data obtained by sensing device 106 to determine whether any cards of the plurality of cards comprise a flaw or a sign of usage (e.g., a marking, an indent, a cut, a hole, ink or surface wear, bending, etc.) and are thus unsuitable for sorting and recovering. For example, flaw detecting device 106 compares the images and/or data obtained for each card with a stored reference (e.g., an image of the card having no flaws) and determines whether any variations exist between the obtained images and/or data and the stored reference. Moreover, authentication device 110 uses the images and/or data obtained by sensing device 106 to determine whether each card of the plurality of cards comprises a particular authenticity feature (e.g., a unique serial number or barcode, a watermark, a hologram, a security thread, optically variable ink, a chip, microtext, a pattern, or other marking).

Furthermore, card classifier 114 uses the images and/or data obtained by sensing device 106 to identify a characteristic marking on each card (e.g., a design, a pattern, or other marking) or a shape of each card. Controller 101, operating as pocket assignment determining device 101B (as depicted in FIG. 2), is configured to utilize this information to separate the plurality of cards into different groups. In other words, controller 101 sorts and recovers decks of cards belonging to the same group based on each card's characteristic markings.

Flaw detecting device 108, authentication device 110, and card classifier 114 may be associated with or independent of controller 101. In certain embodiments of the invention, controller 101 operates as one or more of flaw detecting device 108, authentication device 110, and card classifier 114.

In such a configuration, when flaw detecting device 108 determines that a card of the plurality of cards has a flaw or a sign of usage, that card is sent to card disposing device 112, examples of which include a conventional shredder, an incinerator, or other device that is capable of disposing of or destroying cards. Controller 101, operating as instructing device 101C (as depicted in FIG. 2), is configured to instruct card disposing device 112 to dispose of the card. Similarly, when authentication device 110 determines that a card of the plurality of cards does not satisfy a particular authenticity feature, that card is sent to card disposing device 112.

Cards that are authenticated (e.g., determined to have a particular authenticity feature) and are otherwise suitable for sorting and recovering (e.g., determined to not have any flaws or signs of usage) are distributed to an individual output pocket 120. Specifically, for each of the cards, controller 101, operating as pocket assignment determining device 101B (as depicted in FIG. 2), determines whether an output pocket 120 is missing the card (e.g., needs the card to complete a deck) based on the identity (e.g., suit and rank) of the card. Examples of output pockets 120, include: pockets, trays, bins, chutes, stackers, or any other structure capable of receiving cards and holding the cards such that they form decks or stacks in the order received. In the illustrated embodiment, cards are distributed to fixed output pockets 120 but movable pockets are also suitable.

When controller 101 determines that none of output pockets 120 are missing a card, that card is sent to a card holding device 118. Suitable card holding devices include any device capable of receiving, holding, and dispensing cards under the instruction of a controller (e.g., controller 101). An example of card holding device 118 is an additional output pocket that is capable of receiving and holding cards. Another example of card holding device 118 is using spools of the type presently used in currency recycling machines, although adapted (e.g., shaped accordingly) to hold cards. Controller 101, operating as instructing device 101C (as depicted in FIG. 2), instructs card holding device 118 to hold a rejected card (e.g., a card that is not missing from any pocket 120) for a predetermined period of time. After the predetermined period of time, controller 101, operating as pocket assignment determining device 101B (as depicted in FIG. 2), determines once again whether a pocket 120 is missing the card.

When a specific output pocket 120 holds a plurality of distributed cards that forms a complete deck, card banding device 124 bands or wraps the plurality of distributed cards. A pocket monitoring device monitors output pockets 120 to determine when a specific output pocket 120 holds a complete deck of cards. In certain embodiments of the invention, controller 101 is configured to operate as the pocket monitoring device. As an example, in FIG. 2, controller 101 operates as pocket monitoring device 101D.

Banding involves, for example, using a section of material to bind, tape, or otherwise hold together one or more cards. In one example, a strip of is used to hold the plurality of distributed cards together. A labeling device (e.g., a label printer) is used to label the strip of paper with information such as the pocket that the cards came from, a date and time (e.g., the date and time that the banding was completed), the type of card or group associated with the card, etc. Additionally, resetting device 125 resets the specific output pocket 120 to receive a new deck of cards. Specifically, resetting device 125 indicates that the specific output pocket 120 is ready to receive a new deck of cards by clearing information stored about the specific output pocket 120. Resetting device 125 is either associated with or independent of controller 101. In certain embodiments of the invention, controller 101 is configured to operate as resetting device 125.

After card recovering apparatus 100 has sorted, recovered, and/or disposed of each of the plurality of cards placed in feeder 104, report generating device 122 generates a sorting report. The sorting report can include a list of disposed cards (in other words, cards of the plurality of cards that were disposed by card disposing device 112). In addition, the sorting report can include a list of cards that a pocket 120 is still missing. A counting device determines whether a pocket 120 is still missing a card. When a pocket is still missing a card, a missing card identifying device determines an identity of the missing card. The counting device and the missing card identifying device may be associated with or independent of controller 101. In certain embodiments of the invention, controller 101 operates as the counting device and/or the missing card identifying device. As an example, in FIG. 2, controller 101 operates as counting device 101E and missing card determining device 101F. The sorting report can also include a total number of decks that were recovered by card recovering apparatus 100. In cases involving multiple types or groups of cards, the total number of decks can be broken up based on type and/or group.

Report sending device 123 then sends the sorting report to an administrator (e.g., management or security). Specifically, report sending device 123 sends a message containing the sorting report to the administrator. Upon receiving the sorting report, the administrator is able to take necessary steps to recover or obtain any cards that are still missing or needed.

In addition to sorting decks of cards, card recovering apparatus 100 may also be adapted to process header cards for separating decks into different groups, for example, decks originating from different gaming tables. In such cases, card recovering apparatus 100 obtains information about cards that are being sorted and recovered from the header cards. For example, in situations when only partial decks of cards are being collected for sorting/recovering (for example, when only the unused cards in a shoe are collected), header cards may be used track the number of cards that were removed from the decks (for example, in the case involving unused cards in a shoe, this number would represent the number of cards that were used) and provide that information to card recovering apparatus 100. Such information would facilitate future efforts to balance the number of cards that are assigned/distributed to different gaming tables. Header cards processed by card recovering apparatus 100 are separated from the other cards by controller 101. Specifically, as noted above, controller 101 is capable of separating cards into different groups based on their characteristic markings. Thus, in such a case, controller 101 identifies each header card based on its characteristic markings and sorts it into a separate pocket 120. The number and arrangement of pockets 120 are modified as necessary to accommodate header cards and/or different groups of cards.

Card recovering apparatus 100 may also be adapted for use in a secure card room of a casino. In such cases, a card recovering apparatus is configured to identify, verify, sort, and/or recover incoming and outgoing decks of cards. New cards are placed in feeder 104, and card recovering apparatus 100 processes them to an output pocket 120. Card recovering apparatus 100 is programmed to identify all types of cards including material (e.g., paper, plastic, etc.), design, and color makeup. The apparatus preferably stores the results of any completed sorting to provide an electronic trail of the sorting and/or prints the result to provide a paper trail. The results of a sorting can include, for example, a list of cards that were disposed of during the sorting process, a list of missing cards in any output pocket 120 at the completion of the sorting, and/or a total number of decks recovered by the sorting.

In certain embodiments of the invention, multiple recovery cycles are possible. For example, a single card may be recovered more than one time by card recovering apparatus 100. As noted above, card recovering apparatus is capable of sorting and recovering cards that remain unused after a first shift at a casino. Note that cards that have been used can also be recovered by card recovering apparatus 100. Recovered cards can be redistributed to a gaming table during a second shift at the casino. Cards that remain unused during the second shift may again be sorted and recovered by card recovering apparatus, and so on and so forth. In cases involving multiple recovery, a robust fitness detection process must be employed to ensure that recovered cards are free from flaws and/or any signs of usage (e.g., ink wear, surface wear, color changes, etc.).

In some embodiments of the invention, sets of cards (e.g., complete decks of cards, incomplete decks of cards) that are recovered by card recovering apparatus 100 are disposed of and/or destroyed by card disposing device 112 in order to establish a balance between the number of recovered cards and new cards used during a shift or table game session at a casino. Incomplete decks of cards that are recovered by card recovering apparatus 100 can be disposed of and/or destroyed to maintain a consistent number of each card.

In particular embodiments of the invention, card recovering apparatus 100 may not include one or more of flaw detecting device 108, authentication device 110, card classifier 114, card holding device 118, report generating device 122, report sending device 123, and resetting device 125.

Figure 3A:
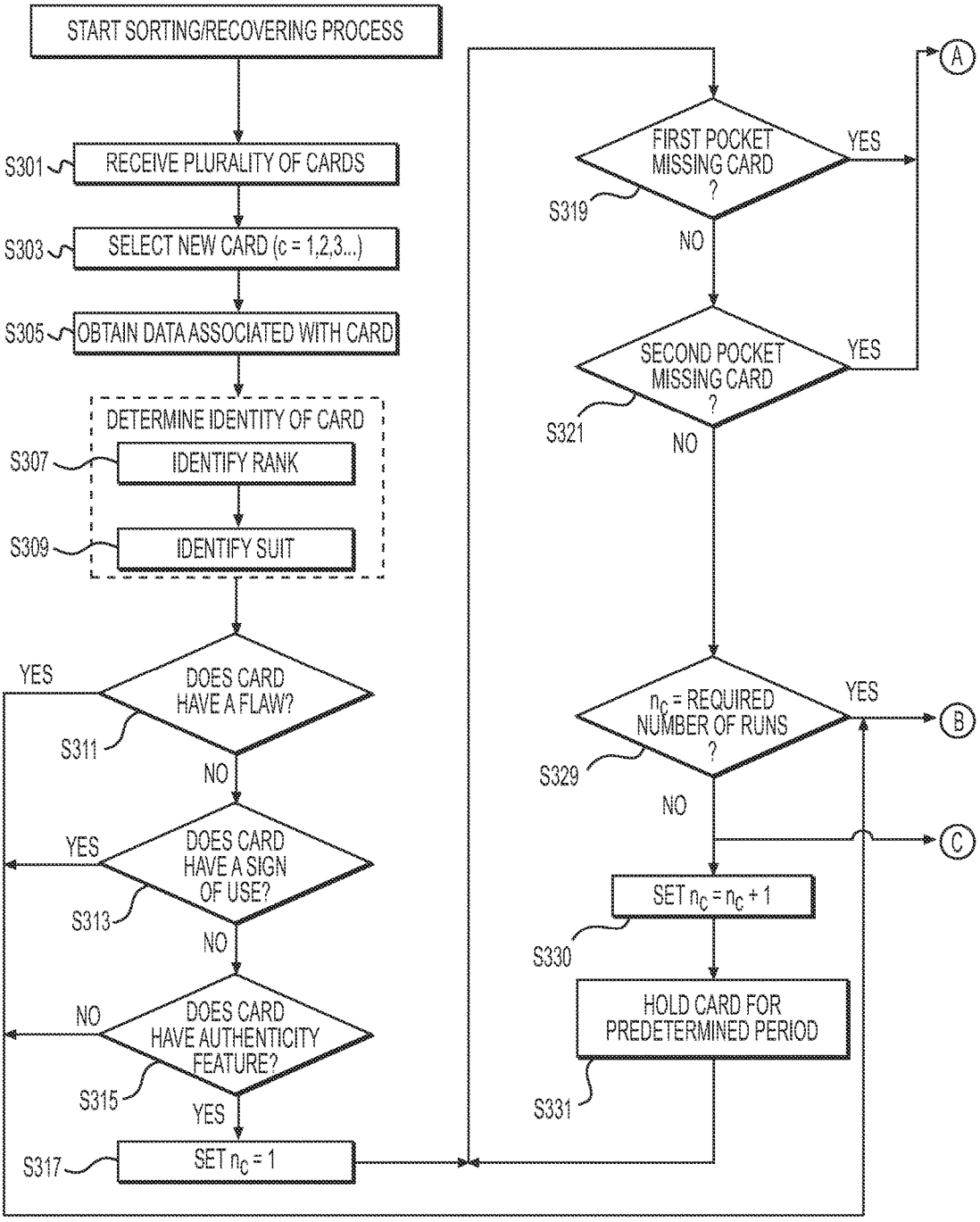
FIGS. 3A and 3B depict a flowchart that illustrates an exemplary method for automatically sorting and recovering cards according to an embodiment of the invention.
Figure 3B:
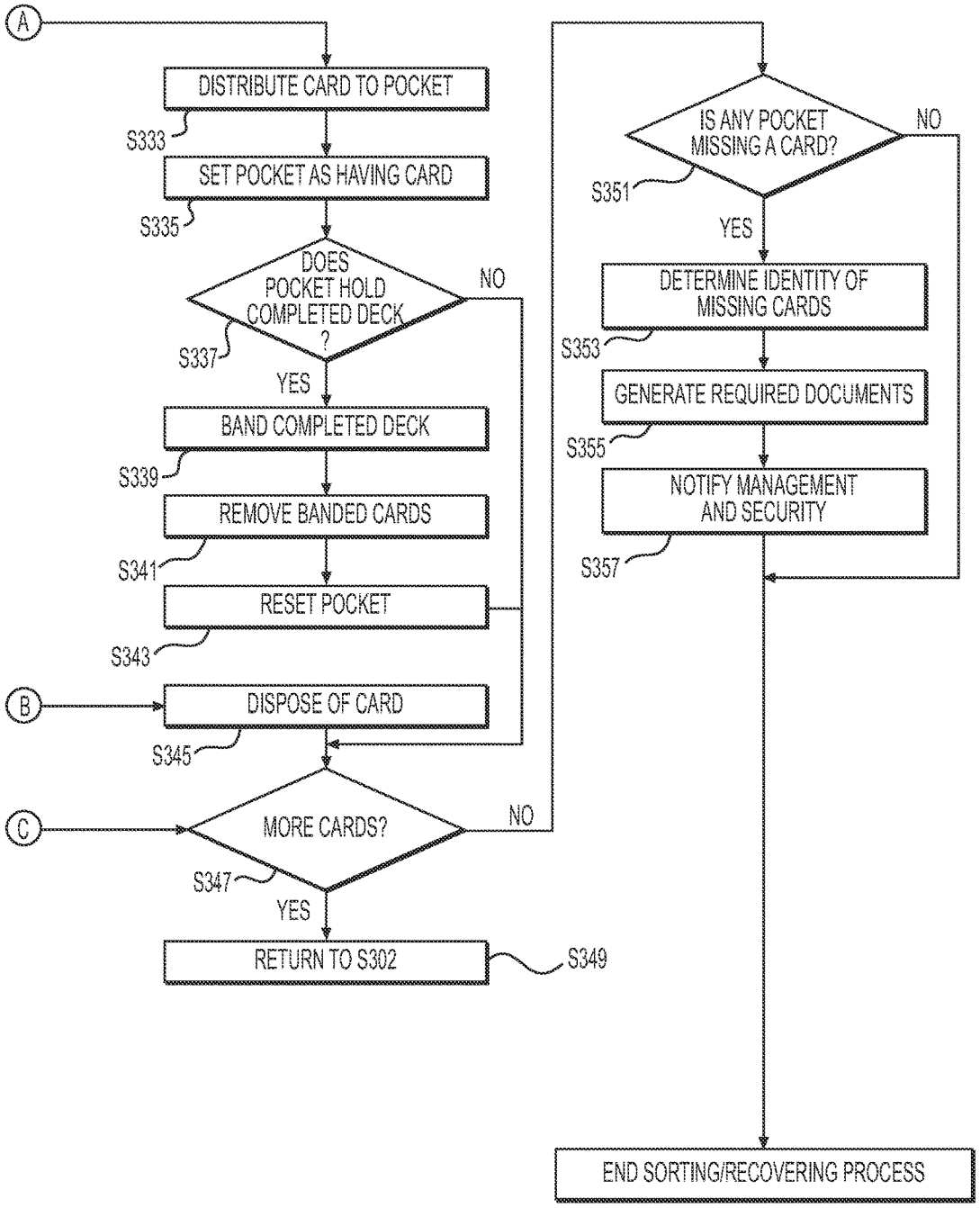
Figure 4:
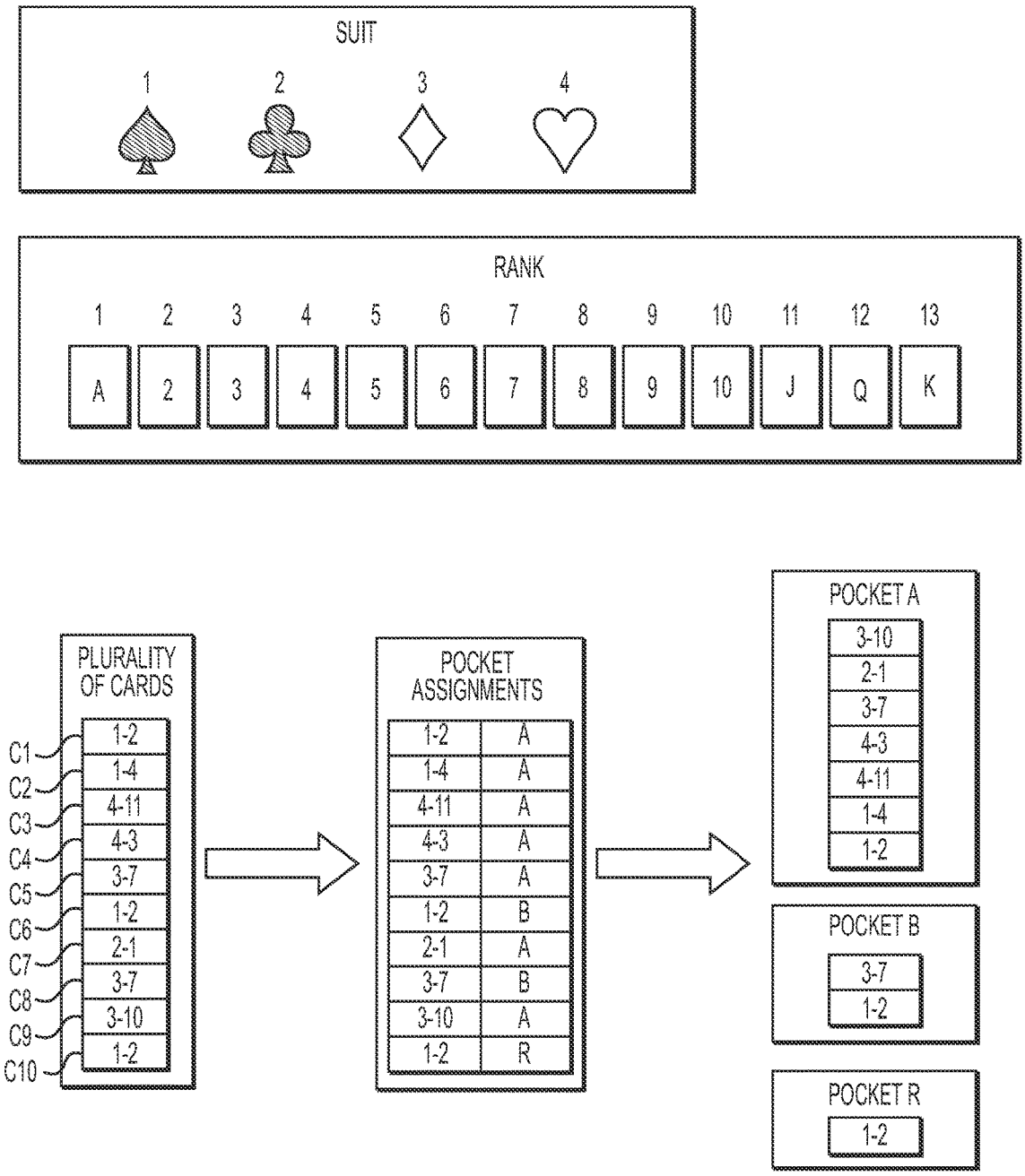
FIG. 4 depicts an example of sorting and recovering a plurality of cards according to the exemplary method depicted in FIGS. 3A and 3B.

Referring to FIGS. 3A, 3B, and 4, an exemplary process performed by card recovering apparatus 100 now is described. FIGS. 3A and 3B depict a method for automatically sorting and recovering cards. FIG. 4 depicts an example of sorting and recovering a plurality of cards C1-C10, according to the method depicted in FIGS. 3A and 3B. First, the plurality of cards, such as set of playing cards, is placed in feeder 104. As depicted in FIG. 4, each of the plurality of cards is identified by rank and suit. Specifically, each card is one of four suits—spade, club, diamond, and heart—and one of thirteen ranks—Ace, two through ten, Jack, Queen, and King, whereby each suit and rank may be represented by a number. Thus, in FIG. 4, the four suits are represented by numbers one (1) through four (4), respectively, and the thirteen ranks may be represented by numbers one (1) through thirteen (13), respectively.

In S301, feeder 104 receives the plurality of cards. In S303, feeder 104 separates a first card from the plurality of cards, and transport device 105 transports the first card to sensing device 106. In S305, sensing device 106 obtains data associated with the first card. As described above, obtaining data associated with a card involves, for example, capturing an image of the card or a portion of the card. Alternatively, obtaining data associated with a card involves retrieving information about the card from an information resource (e.g., a local or remote server, network, or other device). In S307 and S309, controller 101, operating as identity determining device 101A, identifies the first card by rank and suit by analyzing (e.g., examining, inspecting, scanning, etc.) the data associated with the first card.

In S311 and S313, flaw detecting device 108 checks the first card for any flaws, signs of usage, or other items that may allow a player to gain an unfair advantage during a game. Checking the first card for a flaw or sign of usage involves, for example, analyzing the data associated with the first card that was obtained by sensing device 106 (e.g., an image of the first card) and determining whether that data reveals a flaw or a sign of usage. Cards that are found to have any flaws (S311: YES) or signs of usage (S313: YES) are sent to card disposing device 112, and the process proceeds to S345. In S345, card disposing device 112, as instructed by controller 101 operating as instructing device 101C, shreds, incinerates, or otherwise disposes of such cards.

In S315, authentication device 110 determines whether the first card possesses a predetermined authenticity feature such as, for example, a unique serial number or a specific mark for a particular casino. Determining whether the first card comprises a predetermined authenticity feature involves, for example, analyzing the data associated with the first card that was obtained by sensing device 106 (e.g., an image of the first card) and determining whether the predetermined authenticity feature is present in the data. Cards that are found to not have the predetermined authenticity feature (e.g., cards that do not have a serial number, have a duplicate serial number, or an invalid serial number) (S315: NO) are also sent to card disposing device 112.

Cards that are marked for disposal may also be manually inspected and placed back in card recovering apparatus 100 to be sorted when no flaw or sign of usage is found and/or the cards have the predetermined authenticity feature. Cards that are authenticated via a different method (e.g., determined to have a different authenticity feature) may also be placed back in card recovering apparatus 100. When flaws are confirmed during manual inspection or when a questionable card (e.g., a card lacking the predetermined authenticity feature) is identified, appropriate documents or reports can then be generated, management or security notified, and/or other steps taken as necessary.

Those of ordinary skill in the art will appreciate that S311 (checking for flaws), S313 (checking for signs of usage), and S315 (checking for a predetermined authenticity feature) are performed in any order or concurrently. Moreover, S311, S313, and S315 are performed before, during, or after card identification (S307 and S309), either as a part of the card identification process or as a separate process.

Continuing now to S317, S319, and S321, when the first card is suitable for sorting and recovering (in other words, can be authenticated and does not have any flaws or signs of usage), transport device 105 transports the first card to the card sorting device 116. Then, controller 101, operating with card sorting device 116, performs a first round of sorting. Specifically, a counter $n_C$ is used to track the sorting. At the start of the first round of sorting, the counter $n_C$ is set to one (1) to signify the start of the first round of sorting. In S319, controller 101, operating as pocket assignment determining device 101B, determines whether a first output pocket 120 is missing the first card (e.g., needs the first card to complete a deck). In FIG. 4, the first output pocket 120 corresponds to a pocket A. When the first output pocket 120 is missing the first card (S319: YES), controller 101, operating as instructing device 101C, instructs card sorting device 116 to distribute the first card to the first output pocket 120 (S333). When the first output pocket is not missing the first card (S319: NO), the process proceeds to S321, where controller 101 determines whether a second output pocket 120 is missing the first card. In FIG. 4, the second output pocket 120 corresponds to a pocket B. Thereupon, when the second output pocket 120 is missing the first card (S321: YES), controller 101 instructs card sorting device 116 to distribute the first card to the second output pocket 120 (S333). When the first card is distributed to the first or second output pocket 120, controller 101 or a separate device will record that the relevant pocket is no longer missing the first card (S335).

The process of determining whether an output pocket 120 is missing the first card may be repeated until controller 101 checks each and every output pocket 120 of card recovering apparatus 100. For example, when additional output pockets 120 (e.g., a pocket C, a pocket D, etc.) exist, controller 101 proceeds to a next output pocket, according to an order set by a predetermined scheme, and determine whether that output pocket is missing the first card from a complete set according to the predetermined scheme. An example of the complete set according to the predetermined scheme is a full deck of playing cards. When that output pocket is missing the first card, controller 101 instructs card sorting device 116 to distribute the first card to that output pocket. When that output pocket is not missing the first card, controller 101 proceeds to yet another output pocket, in the order set by the predetermined scheme, and determines whether that pocket is missing the first card, and so on and so forth. In the example depicted in FIG. 4, the process only involves two pockets, pocket A and pocket B, but embodiments of the invention utilize 1, 2, 3 or more pockets.

Continuing to S329, S330, and S331, when none of output pockets 120 are missing the first card, controller 101 determines whether counter $n_C$ exceeds a predetermined number of runs or rounds of sorting. More specifically, in S329, controller 101 determines whether a sufficient or required number of rounds of sorting have been performed. When a sufficient number of rounds have been performed (S329: YES), the process proceeds to S345 and controller 101 instructs card disposing device 112 to dispose of the first card. When a sufficient number have not been performed (S329: NO), the process proceeds to S330 and S347. In S330, counter $n_C$ is increased by one (1). Thus, when only one round of sorting has been performed, counter $n_C$ is set to two (2).

Those of ordinary skill in the art will appreciate that a system other than a count system may be used to track the sorting. Moreover, in certain embodiments, the sorting is not tracked; cards that are suitable for sorting may undergo as many rounds of sorting as necessary until they are sorted into an output pocket 120.

Referring now to S331, holding device 118, instructed by controller 101 operating as instructing device 101C, will hold the first card for a predetermined period of time. The holding device 118 may be referred to as a "reject pocket." As described above, holding device 118 is, for example, an additional output pocket 120 that is configured to hold any rejected cards. Rejected cards include those cards that are not sorted to an output pocket 120 during a round of sorting. More specifically, rejected cards are those cards that none of output pockets 120 are missing at the time they are sorted. Holding device 118 may hold the card for a specific period of time (e.g., a number of seconds, minutes, hours, or days) or until each of the plurality of cards has undergone at least one round of sorting. After that time, holding device 118 passes the card back to card sorting device 116, and the process returns to S319. A second round of sorting then commences.

In addition, during the predetermined period of time, the process also proceeds to S347. In S347, controller 101 determines whether there are more cards in the plurality of cards (S347). When there are more cards (S347: YES), the process will proceed back to S303, and a new card of the plurality of cards will be selected. When there are no more cards (S347: NO), the process will proceed to S351.

In certain embodiments, rounds of sorting are performed without a count system. More specifically, when a card is suitable for sorting and recovering (in other words, is genuine and fit) but none of output pockets 120 is currently missing the card, the card is sent to holding device 118. After a period of time, that card and any other cards in holding device 118 are collected and placed back into feeder 104. This process may be performed manually by a user. The cards are then reexamined for authenticity and flaws, which may be preferable when a particular card is processed too many times. In such embodiments, card recovering apparatus 100 need not track of the rounds of sorting nor the predetermined period of time (in other words, S317, S329, and S331 may be omitted).

Controller 101, operating as pocket monitoring device 101D, also checks to see whether an output pocket 120 holds a plurality of distributed cards that comprise a complete deck. Such monitoring can be performed each time a card of the plurality of cards is distributed to an output pocket 120 (in other words, following S337). Alternatively, controller 101 periodically checks output pockets 120 to determine whether any hold a plurality of distributed cards comprising a complete deck. When controller 101 determines that a specific output pocket 120 holds a plurality of distributed cards that comprise a complete deck (S337: YES), banding device 124 bands the plurality of distributed cards in that specific output pocket 120 (S339). The banded plurality of distributed cards then is removed from the specific output pocket 120 (S341), and the specific output pocket 120 is reset by resetting device 125 (S343). In certain embodiments of the invention, S341 is omitted. Thus, in such configurations, the banded plurality of distributed cards continue to be held in the specific output pocket 120.

In embodiments of the invention, multiple decks of cards are processed at the same time. Accordingly, even if cards are missing from a single deck, several complete decks can be formed with the plurality of cards. After the plurality of cards have all been sorted (i.e., distributed to an output pocket 120, disposed of by card disposing device 112, etc.), in S351, controller 101, operating as counting device 101E, determines whether any output pocket 120 is still missing a card. In other words, controller 101 determines whether any output pocket 120 still has an incomplete deck of cards. When a specific output pocket 120 is found to have a missing card (S351: YES), controller 101, operating as missing card determining device 101F, will determine an identity of the missing card (S353). In S355, report generating device 122 then will generate a sorting report including the identity of the missing card. In S357, report sending device 123 will send the sorting report to an administrator (e.g., management or security), thereby notifying them of the missing card. Steps can then be taken to obtain the missing card and complete the deck. Alternatively, the incomplete deck of cards may be collected and destroyed or treated as rejected cards and reprocessed with the next batch of cards.

In certain embodiments, when more than one output pocket 120 has an incomplete deck of cards, controller 101 determines whether the incomplete decks may be resorted to form one or more complete decks of cards. Such a situation may arise when a particular card is distributed to a later output pocket 120 because an earlier output pocket 120 already has the particular card at the time it is sorted. However, once the cards in that earlier output pocket 120 are banded, that output pocket 120 may collect new cards but, at the end, still require the particular card to form a complete deck. When controller 101 determines that the incomplete decks comprise one or more complete decks, card recovering apparatus 100 resorts the incomplete decks to recover those complete decks.

Returning to S351, when none of output pockets 120 is missing a card (S351: NO), the process terminates.

In certain embodiments of the invention, more than one card of the plurality of cards is selected and sorted at the same time (e.g., in S303, more than one card may be selected). Moreover, in certain embodiments, one or more of S311 (checking for flaws), S313 (checking for signs of usage), and S315 (checking for a predetermined authenticity feature) is omitted. In addition, in certain embodiments, S317, S329, S330, and S331 may be omitted. Accordingly, in such embodiments, only one round of sorting may be performed. Further, in certain embodiments, S351, S353, S355, and S357 are omitted. Accordingly, in such configurations, the process terminates when controller 101 determines that there are no more new cards remaining in the plurality of cards (S347: NO).

Referring back now to the example depicted in FIG. 4, the plurality of cards C1-C10 are sorted according to the method depicted in FIGS. 3A and 3B. Each of the plurality of cards is sorted based on a predetermined scheme. Specifically, each card is sorted into one of pocket A, pocket B, and a pocket R, which are initially empty. Note that, in other embodiments, pocket A, pocket B, and/or pocket R may not be empty (e.g., pocket A, pocket B, and/or pocket R may start out holding one or more cards). For a specific card, controller 101, operating as pocket assignment determining device 101B, determines whether a first output pocket 120, pocket A, is missing that card. When controller 101 determines that pocket A is missing the specific card, controller 101 assigns the specific card to pocket A. When controller 101 determines that pocket A is not missing the specific card (e.g., pocket A already has the specific card), controller 101 then determines whether a second output pocket 120, pocket B, is missing the specific card. When controller 101 determines that pocket B is missing the specific card, controller 101 assigns the specific card to pocket B. However, when controller 101 determines that pocket B is also not missing the specific card, controller 101, for example, disposes of the specific card by assigning that card to pocket R, which may be a shredder, incinerator, or other device that is capable of disposing of cards. In such a configuration, pocket R corresponds to card disposing device 112.

As depicted in FIG. 4, a first card, C1, is selected from the plurality of cards. Controller 101, operating as identity determining device 101A, determines a suit "spades" and a rank "two" of C1. Accordingly, the identity of C1 is represented as "1-2," where "1" represents the suit "spades" and "2" represents the rank "two." In accordance with the predetermined scheme outlined above and depicted in FIGS. 3A and 3B, controller 101 then determines whether pocket A is missing C1. Determining whether pocket A is missing C1 involves, for example, determining whether pocket A already holds a card with the same identity as C1 (in other words, a two of spades or a card having the identity "1-2"). Since pocket A is initially empty and C1 is the first card, controller 101 determines that pocket A is missing C1. Accordingly, controller 101 assigns C1 to pocket A.

Subsequently, a second card, C2, is selected from the plurality of cards. Controller 101 determines that C2 is a four of spades; thus, the identity of C2 is represented as "1-4." Controller 101 then determines that pocket A is also missing C2. Accordingly, controller 101 also assigns C2 to pocket A.

The above process is repeated with the rest of the cards, C3-C10. C3-05, C7, and C9 are also assigned to pocket A. C6 is assigned to pocket B because C6 has the same identity as C1 (in order words, C6 also has a suit "spades" and a rank "two"). Similarly, C8 is also assigned to pocket B. Lastly, C10 is assigned to pocket R or, in other words, it is rejected and assigned for disposal or resorting.

Each of the plurality of cards is sorted to one of pocket A, pocket B, and pocket R according to each card's pocket assignment. Cards are stacked in one of pocket A and pocket B based on the order that they are received. Thus, in FIG. 4, C1 is at the bottom of the stack in pocket A, followed by C2, C3, C4, C5, C7, and C9. Similarly, C6 is at the bottom of the stack in pocket B, followed by C8. By arranging and stacking cards this way, card recovering apparatus 100 is capable of recovering pre-shuffled decks of cards. Specifically, cards in each deck recovered by card recovering apparatus 100 will already be randomized based on the order that they were received and processed by card recovering apparatus 100.

In certain embodiments, pocket R corresponds to card holding device 118 instead of card disposing device 112. Pocket R, for example, holds cards that are assigned to it for a predetermined period of time and subsequently delivers those cards back to card sorting device 116. Controller 101, operating as pocket assignment determining device 101B, will then determine once again whether pocket A or pocket B is missing the card. Alternatively, cards that are sent to pocket R are held for a period of time and then placed back into feeder 104.

Figure 5A:
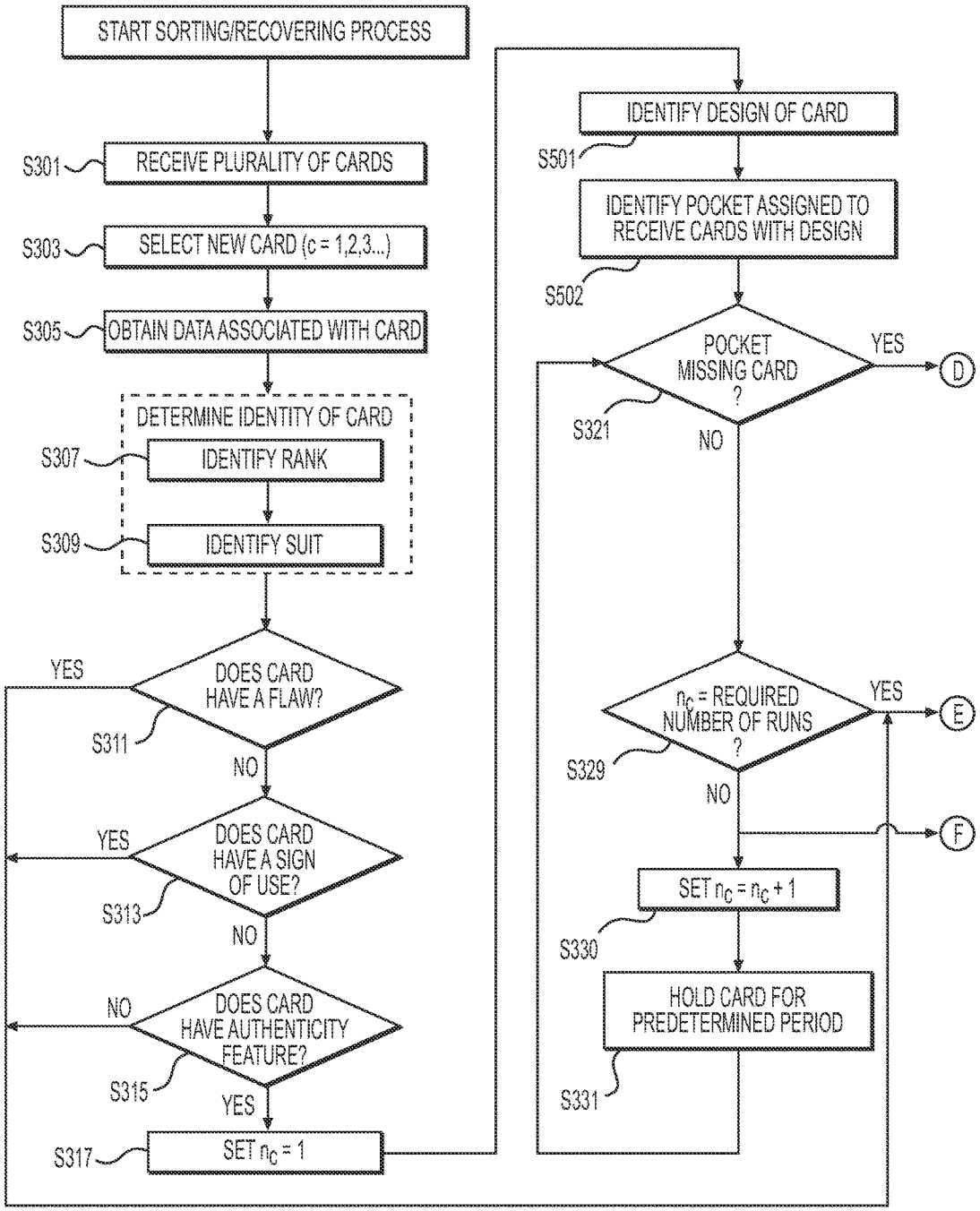
FIGS. 5A and 5B depict a flowchart that illustrates another exemplary method for automatically sorting and recovering cards according to an embodiment of the invention.
Figure 5B:
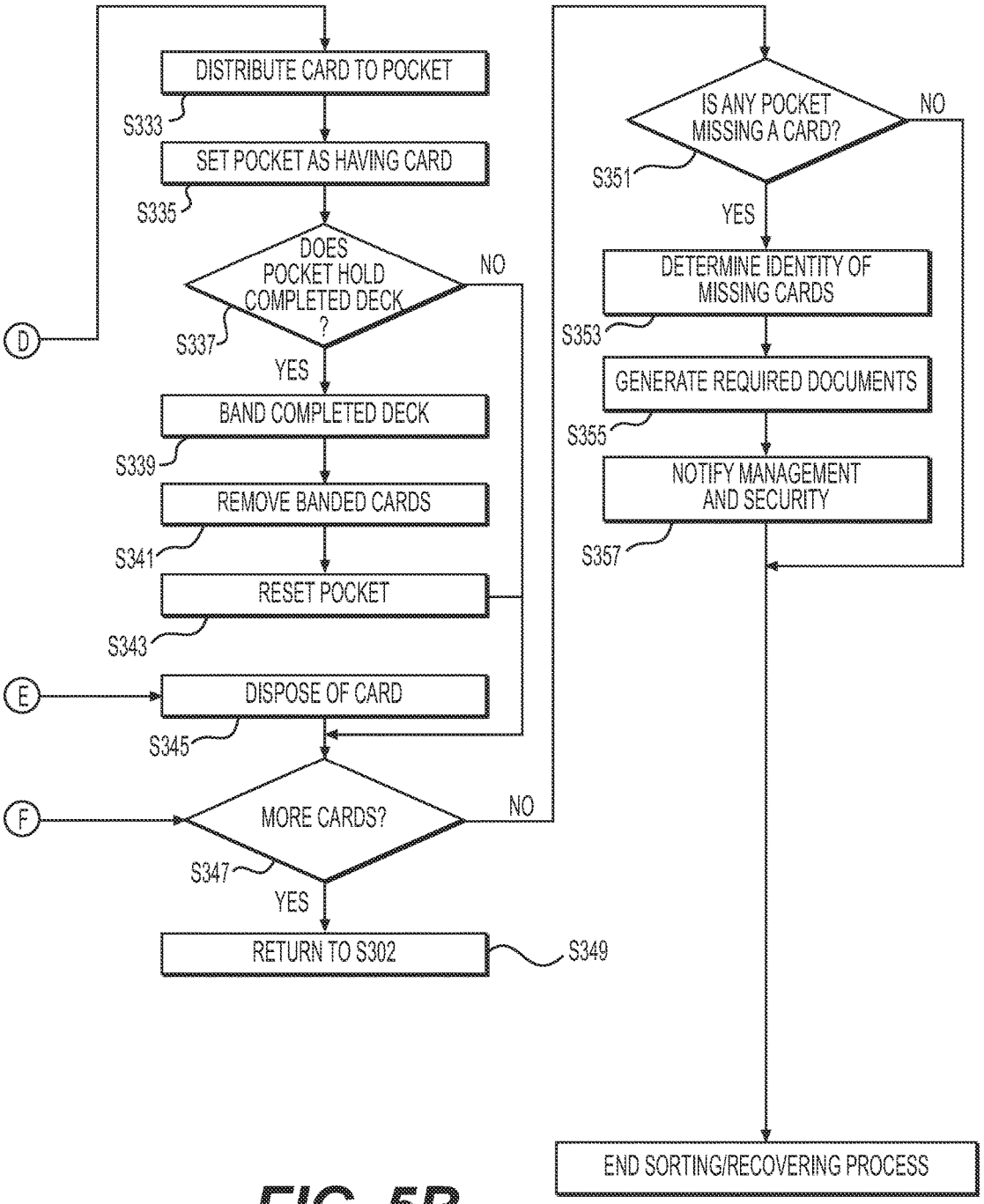
Figure 6:
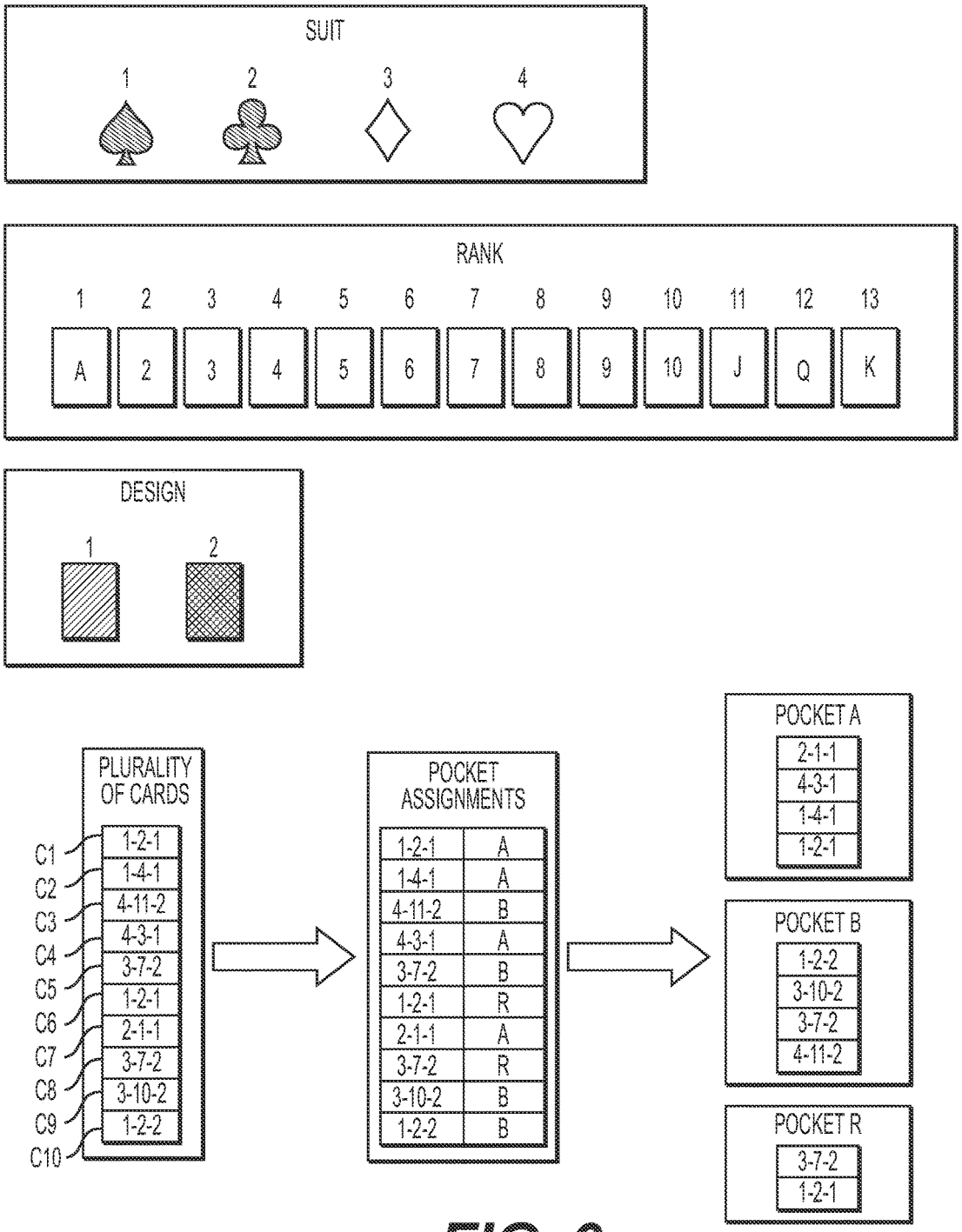
FIG. 6 depicts an example of sorting and recovering a plurality of cards according to the exemplary method depicted in FIGS. 5A and 5B.

Referring to FIGS. 5A, 5B, and 6, another exemplary process performed by card recovering apparatus 100 now is described. FIGS. 5A and 5B depict a method for automatically sorting and recovering cards. FIG. 6 depicts an example of sorting and recovering a plurality of cards C1-C10, according to the method depicted in FIGS. 5A and 5B. S301-S357, as depicted in FIGS. 5A and 5B, are the same as S301-S357 described above in connection with FIGS. 3A and 3B. Thus, the process depicted in FIGS. 5A and 5B is the same as the process depicted in FIGS. 3A and 3B, except that additional steps, S501-S502, are added. In S501, card classifier 114 uses data associated with a selected card to identify a characteristic marking on the selected card. As described above, such a characteristic marking is, for example, a design. Identifying a design of the selected card involves, for example, analyzing the data associated with the selected card (e.g., an image of the selected card that was obtained by sensing device 106) and recognizing a specific design that is printed, stamped, engraved, or otherwise marked on the selected card. In S502, controller 101, operating as pocket assignment determining device 101B, then identifies one or more output pockets 120 that are assigned to receive cards with the characteristic marking. And, in S321, controller 101 determines whether a first output pocket of those one or more pockets 120 is missing the selected card with the characteristic marking.

Similar to S319 and S321, as depicted in FIG. 3A, the process of determining whether an output pocket 120 that is assigned to receive cards with the characteristic marking is missing the selected card can be repeated until controller 101 checks each and every output pocket 120 that is assigned to receive cards with the characteristic marking. In the example depicted in FIG. 6, pocket A is assigned to receive cards having a first design, and pocket B is assigned to receive cards having a second design. The first design, represented by a number "1," has a striped background; and the second design, represented by a number "2," has a diamond background.

Referring now to the example depicted in FIG. 6, the same plurality of cards C1-C10 are sorted according to the method depicted in FIGS. 5A and 5B. Similar to FIG. 4, each of the plurality of cards is sorted based on a predetermined scheme. However, unlike FIG. 4, pockets A and B are each assigned to receive cards with a particular design. Thus, after card classifier 114 identifies the particular design that is on a specific card, that card is sorted according to that particular design. In other words, when card classifier 114 determines that a specific card has the first design, controller 101, operating as pocket assignment determining device 101B, determines whether pocket A is missing the specific card. When controller 101 determines that pocket A is missing the specific card, controller 101 assigns the specific card to pocket A. When controller 101 determines that pocket A is not missing the specific card (e.g., pocket A already has the specific card), controller 101 then disposes of the specific card by assigning that card to pocket R. Alternatively, when card classifier 114 determines that a specific cards has the second design, controller 101 determines whether pocket B is missing the specific card. When controller 101 determines that pocket B is missing the specific card, controller 101 assigns the specific card to pocket B. When controller 101 determines that pocket B is not missing the specific card, controller 101 then disposes of the specific card by assigning that card to pocket R.

In FIG. 6, card classifier 114 identifies the first design on C1, C2, C4, C6, and C7 and the second design on C3, C5, C8, C9, and C10. Thus, in accordance with the predetermined scheme outlined above and depicted in FIGS. 5A and 5B, C1, C2, C4, and C7 are assigned to pocket A and C3, C5, C9, and C10 are assigned to pocket B. C6 is assigned to pocket R because C1 and C6 have the same identity, and, assuming that C1 is sorted before C6, when controller 101 determines whether pocket A is missing C6, controller 101 would determine that pocket A already has a card with the same identity as C6. Similarly, C8 is also assigned to pocket R because C5 and C8 have the same identity. Note that the results of the sorting depicted in FIG. 6 differs from the results of the sorting depicted in FIG. 4 because pockets A and B are assigned to receive different types or groups of cards. Consequently, cards that may be sorted into pocket A cannot be sorted into pocket B, and vice versa, reducing the number of output pockets 120 into which a specific card may be sorted.

While the invention has been described in connection with preferred embodiments, it will be understood by those of ordinary skill in the art that other variations and modifications of the preferred embodiments described above may be made without departing from the scope of the invention. Other embodiments will be apparent to those of ordinary skill in the art from a consideration of the specification or practice of the invention disclosed herein. It will also be understood by those of ordinary skill in the art that the scope of the invention is not limited to use in casinos or other establishments dedicated to gambling, or to traditional playing cards, but rather that embodiments of the invention may be used in any establishment having a need to sort and recover cards of any type. It will also be understood by those of ordinary skill in the art that card recovery apparatuses of greater or lesser number of output pockets than disclosed herein can be employed. The specification and the described examples are considered as exemplary only, with the true scope and spirit of the invention indicated by the following claims.

What is claimed is:

1. An apparatus for automatically sorting and recovering cards, the apparatus comprising:

a card feeder configured to receive a plurality of cards;

a card sensor configured to obtain data associated with each of the plurality of cards;

a card sorter configured to distribute a card to one of a plurality of pockets according to a predetermined scheme to form a complete set;

a controller configured to, for each of the plurality of cards:

determine an identity of the card based on the data associated with the card;

determine whether the card comprises a predetermined authenticity feature based on an image of the card;

wherein when the card comprises the predetermined authenticity feature:

determine whether at least one pocket of the plurality of pockets is missing the card from the complete set based on the identity of the card, each of the plurality of pockets configured to hold one or more cards of the plurality of cards;

instruct the card sorter to distribute the card only to a pocket of the at least one pocket of the plurality of pockets that is missing the card based on the predetermined scheme in response to determining that the at least one pocket of the plurality of pockets is missing the card;

instruct the card sorter to distribute the card to a holding pocket in response to determining that the at least one pocket of the plurality of pockets is not missing the card from the complete set, the holding pocket configured to hold the card; and a card transport path configured to transport the plurality of cards from the card feeder to the card sensor and the card sorter; and a card disposal configured to dispose of any card of the plurality of cards conveyed to the card disposal by the card sorter;

wherein the card sensor is configured to obtain the data associated with each of the plurality of cards by capturing the image corresponding to the predetermined authenticity feature for each of the plurality of cards, wherein the controller is configured to instruct the card sorter to convey any card lacking the predetermined authenticity feature to the card disposal;

wherein the controller is configured to reset a specific pocket when the specific pocket holds a plurality of distributed cards comprising the complete set, wherein the controller is configured to instruct the holding pocket to convey any cards distributed to the holding pocket to the card sorter after a first predetermined period of sorting time, and wherein the controller is configured to instruct the holding pocket to convey said any cards distributed to the holding pocket to the card disposal after a second predetermined period of sorting time.

2. The apparatus for automatically sorting and recovering cards according to claim 1, further comprising a card strapper configured to band the plurality of distributed cards comprising the complete set.

3. The apparatus for automatically sorting and recovering cards according to claim 2, wherein the card strapper comprises a strip used to hold the plurality of distributed cards together.

4. The apparatus for automatically sorting and recovering cards according to claim 1, wherein the controller is configured to, for each of the plurality of cards, determine whether the at least one pocket of the plurality of pockets is missing the card from the complete set by:

determining whether a first pocket of the plurality of pockets is missing the card; and determining whether a second pocket of the plurality of pockets is missing the card in response to determining that the first pocket is not missing the card, wherein the at least one pocket of the plurality of pockets comprises the first pocket and the second pocket, wherein the controller is configured to, for each of the plurality of cards, instruct the card sorter to distribute the card to the pocket that is missing the card from the complete set by:

instructing the card sorter to distribute the card to the first pocket in response to determining that the first pocket is missing the card; and instructing the card sorter to distribute the card to the second pocket in response to determining that the second pocket is missing the card after determining that the first pocket is not missing the card, wherein the controller is configured to, for each of the plurality of cards, instruct the card sorter to distribute the card to the holding pocket by instructing the card sorter to distribute the card to the holding pocket in response to determining that the second pocket is not missing the card.

5. The apparatus for automatically sorting and recovering cards according to claim 1, wherein the controller is further configured to, for each of the plurality of cards:

instruct the holding pocket to hold the card for a predetermined period of time in response to instructing the card sorter to distribute the card to the holding pocket; and determine whether the at least one pocket of a plurality of pockets is missing the card after the predetermined period of time.

6. The apparatus for automatically sorting and recovering cards according to claim 1, when each of the plurality of cards has been sorted, the controller is further configured to:

determine whether a particular pocket of the plurality of pockets is missing a particular card from the complete set;

determine an identity of the missing particular card;

generate a sorting report, the sorting report comprising at least one of:

the identity of the missing particular card, and the identity of a disposed card of the plurality of cards; and send the sorting report to an administrator.

7. The apparatus for automatically sorting and recovering cards according to claim 6, wherein the controller is further configured to:

determine whether a further pocket of the plurality of pockets holds the particular missing card; and instructing the card sorter to distribute the particular missing card to the particular pocket in response to determining that the further pocket holds the particular missing card.

8. The apparatus for automatically sorting and recovering cards according to claim 1, for each of the plurality of cards, the controller is further configured to:

determine whether the card comprises at least one of a flaw and a sign of usage, instruct the card disposal to dispose of the card in response to determining that the card comprises the at least one of a flaw and a sign of usage, and instruct the card disposal to dispose of the card by instructing the card disposal to dispose of the card in response to determining that the card does not comprise the predetermined authenticity feature.

9. The apparatus for automatically sorting and recovering cards according to claim 1, for each of the plurality of cards, the controller is further configured to:

identify a characteristic marking on the card;

determine whether the at least one pocket of a plurality of pockets is missing the card from the complete set by:

identifying one or more pockets of the plurality of pockets assigned to receive cards with the characteristic marking; and determining whether at least one of the one or more pockets is missing the card based on the identity of the card.

10. A non-transitory, computer-readable medium configured to store computer-readable instructions that, when executed by a controller of an apparatus comprising a card sorter and the controller, instruct the apparatus to perform a method for automatically sorting and recovering cards, the method comprising:

for each of a plurality of cards:

obtaining data associated with the card;

determining an identity of the card based on the data associated with the card;

determining whether at least one pocket of a plurality of pockets is missing the card from a complete set according to a predetermined scheme based on the identity of the card, each of the plurality of pockets configured to hold one or more cards of the plurality of cards;

distributing, by the card sorter, the card only to a pocket of the at least one pocket of the plurality of pockets that is missing the card from the complete set in response to determining that the at least one pocket of the plurality of pockets is missing the card; and distributing, by the card sorter, the card to a holding pocket in response to determining that the at least one pocket of the plurality of pockets is not missing the card from the complete set, the holding pocket configured to hold the card; and when a specific pocket holds a plurality of distributed cards comprising a complete set, resetting the specific pocket, wherein determining whether at least one pocket of the plurality of pockets is missing the card from the complete set comprises:

determining whether a first pocket of the plurality of pockets is missing the card; and determining whether a second pocket of the plurality of pockets is missing the card in response to determining that the first pocket is not missing the card, wherein distributing the card to the pocket that is missing the card from the complete set comprises:

distributing the card to the first pocket in response to determining that the first pocket is missing the card; and distributing the card to the second pocket in response to determining that the second pocket is missing the card after determining that the first pocket is not missing the card, wherein distributing the card to the holding pocket comprises distributing the card to the holding pocket device in response to determining that the second pocket is not missing the card from the complete set, wherein the computer-readable instructions instruct the apparatus to execute the method further comprises:

conveying any cards distributed to the holding pocket to the card sorter after a first predetermined period of sorting time, and disposing of any cards distributed to the holding pocket by conveying said any cards in the holding pocket to a card disposal after a second predetermined period of sorting time, the card disposal is configured to dispose of the cards conveyed from the holding pocket.

11. The non-transitory, computer-readable medium according to claim 10, wherein the computer-readable instructions instruct the apparatus to execute the method further comprising banding the plurality of distributed cards comprising the complete set.

12. The non-transitory, computer-readable medium according to claim 11, wherein banding the plurality of distributed cards comprising the complete set comprises using a strip to hold the plurality of distributed cards together.

13. The non-transitory, computer-readable medium according to claim 10, wherein the computer-readable instructions instruct the apparatus to execute the method further comprising, for each of the plurality of cards:

holding the card for the predetermined period of sorting time in the holding pocket in response to distributing the card to the holding pocket; and determining whether at least one pocket of a plurality of pockets is missing the card after the first predetermined period of sorting time.

14. The non-transitory, computer-readable medium according to claim 10, wherein the computer-readable instructions instruct the apparatus to execute the method further comprising:

when each of the plurality of cards has been sorted:

determining whether a particular pocket of the plurality of pockets is missing a particular card from the complete set;

determining an identity of the missing particular card;

generating a sorting report, the sorting report comprising at least one of:

the identity of the missing particular card, and the identity of a disposed card of the plurality of cards; and sending the sorting report to an administrator.

15. The non-transitory, computer-readable medium according to claim 14, wherein the computer-readable instructions instruct the apparatus to execute the method further comprising:

determining whether a further pocket of the plurality of pockets holds the missing particular card; and instructing the card sorter to distribute the missing card to the particular pocket in response to determining that the further pocket holds the missing particular card.

16. The non-transitory, computer-readable medium according to claim 10, wherein the computer-readable instructions instruct the apparatus to execute the method further comprising, for each of the plurality of cards:

determining whether the card comprises at least one of a flaw and a sign of usage; and disposing of the card with the card disposal in response to determining that the card comprises the at least one of a flaw and a sign of usage, wherein distributing, by the card sorter, the card to at least one pocket of the plurality of pockets or the holding pocket in response to determining the card does not comprise at least one of a flaw and a sign of usage.

17. The non-transitory, computer-readable medium according to claim 10, wherein the computer-readable instructions instruct the apparatus to execute the method further comprising, for each of the plurality of cards:

determining whether the card comprises a predetermined authenticity feature based on an image of the card, wherein obtaining data associated with the card comprises capturing the image of the card corresponding to the predetermined authenticity feature, wherein disposing of the card further comprises disposing the card with the card disposal in response to determining that the card does not comprise the predetermined authenticity feature, wherein distributing, by the card sorter, the card to at least one pocket of the plurality of pockets or the holding pocket only in response to determining the card comprises the predetermined authenticity feature.

18. The non-transitory, computer-readable medium according to claim 10, wherein the computer-readable instructions instruct the apparatus to execute the method further comprising:

identifying, for each of the plurality of cards, a characteristic marking on the card, wherein determining whether at least one pocket of a plurality of pockets is missing the card comprises:

identifying one or more pockets of the plurality of pockets assigned to receive cards with the characteristic marking; and determining whether at least one of the one or more pockets is missing the card from the complete set based on the identity of the card.

19. A method for automatically sorting and recovering cards, the method comprising:

receiving a plurality of cards;

for each of the plurality of cards:

obtaining data associated with the card via a card sensor;

determining an identity of the card based on the data associated with the card;

determining whether at least one pocket of a plurality of pockets is missing the card from a complete set according to a predetermined scheme based on the identity of the card, each of the plurality of pockets configured to hold one or more cards of the plurality of cards;

distributing, by a card sorter, the card only to a pocket of the at least one pocket of the plurality of pockets that is missing the card from the complete set in response to determining that the at least one pocket of the plurality of pockets is missing the card; and distributing, by the card sorter, the card to a holding pocket in response to determining that the at least one pocket of the plurality of pockets is not missing the card from the complete set, the holding pocket configured to hold the card;

wherein when a specific pocket holds a plurality of distributed cards comprising a complete set, resetting the specific pocket, wherein the method further comprises:

conveying any cards distributed to the holding pocket to the card sorter after a first predetermined period of sorting time, and disposing of any cards distributed to the holding pocket by conveying said any cards in the holding pocket to a card disposal after a second predetermined period of sorting time, the card disposal is configured to dispose of the cards conveyed from the holding pocket.

20. The method for automatically sorting and recovering cards according to claim 19, further comprising banding the plurality of distributed cards comprising the complete set.

21. The method for automatically sorting and recovering cards according to claim 20, wherein banding the plurality of distributed cards comprising the complete set comprises using a strip to hold the plurality of distributed cards together.

22. The method for automatically sorting and recovering cards according to claim 19, wherein determining whether at least one pocket of the plurality of pockets is missing the card from the complete set comprises:

determining whether a first pocket of the plurality of pockets is missing the card; and determining whether a second pocket of the plurality of pockets is missing the card in response to determining that the first pocket is not missing the card, wherein distributing the card to a pocket that is missing the card from the complete set comprises:

distributing the card to the first pocket in response to determining that the first pocket is missing the card; and distributing the card to the second pocket in response to determining that the second pocket is missing the card after determining that the first pocket is not missing the card, wherein distributing the card to the holding pocket comprises distributing the card to the holding pocket in response to determining that the second pocket is not missing the card from the complete set.

23. The method for automatically sorting and recovering cards according to claim 19, further comprising, for each of the plurality of cards:

holding the card in the holding pocket for the first predetermined period of sorting time in response to distributing the card to the holding pocket; and determining whether at least one pocket of a plurality of pockets is missing the card after the first predetermined period of sorting time.

24. The method for automatically sorting and recovering cards according to claim 19, further comprising, when each of the plurality of cards has been sorted:

determining whether a particular pocket of the plurality of pockets is missing a particular card from the complete set;

determining an identity of the particular missing card;

generating a sorting report, the sorting report comprising at least one of:

the identity of the missing particular card, and the identity of a disposed card of the plurality of cards; and sending the sorting report to an administrator.

25. The method for automatically sorting and recovering cards according to claim 24, further comprising:

determining whether a further pocket of the plurality of pockets holds the particular missing card; and instructing the card sorter to distribute the particular missing card to the particular pocket in response to determining that the further pocket holds the particular missing card.

26. The method for automatically sorting and recovering cards according to claim 19, further comprising, for each of the plurality of cards:

determining whether the card comprises a predetermined authenticity feature based on an image of the card, and disposing of the card with the disposal side in response to determining that the card does not comprise the predetermined authenticity feature, wherein obtaining data associated with the card comprises capturing the image of the card, wherein distributing, by the card sorter, the card to a pocket of the at least one pocket of the plurality of pockets or the holding pocket only in response to determining the card comprises the predetermined authenticity feature.

27. The method for automatically sorting and recovering cards according to claim 19, further comprising, for each of the plurality of cards, identifying a characteristic marking on the card, wherein determining whether at least one pocket of a plurality of pockets is missing the card from the complete set comprises:

identifying one or more pockets of the plurality of pockets assigned to receive cards with the characteristic marking; and determining whether at least one of the one or more pockets is missing the card based on the identity of the card.

* * * * *